US006263170B1

(12) United States Patent
Bortnem

(10) Patent No.: US 6,263,170 B1
(45) Date of Patent: Jul. 17, 2001

(54) CONSUMABLE COMPONENT IDENTIFICATION AND DETECTION

(75) Inventor: Mark A. Bortnem, Newberg, OR (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/457,753

(22) Filed: Dec. 8, 1999

(51) Int. Cl.[7] ..... G03G 15/00
(52) U.S. Cl. ..... 399/13; 399/24
(58) Field of Search ..... 399/9, 90, 12, 399/13, 24; 347/19, 7, 86; 377/2, 15, 16; 340/657, 660, 661, 679

(56) References Cited

U.S. PATENT DOCUMENTS

| | | |
|---|---|---|
| 4,279,861 | 7/1981 | Jessop . |
| 4,500,195 | 2/1985 | Hosono . |
| 4,551,000 | 11/1985 | Kanemitsu . |
| 4,585,327 | 4/1986 | Suzuki . |
| 4,634,258 | 1/1987 | Tanaka et al. . |
| 4,686,515 | 8/1987 | Anderson et al. . |
| 4,751,484 | 6/1988 | Matsumoto et al. . |
| 4,774,544 | 9/1988 | Tsuchiya et al. . |
| 4,851,875 | 7/1989 | Tanimoto . |
| 4,889,982 | 12/1989 | Young et al. . |
| 4,939,528 | 7/1990 | Yamamoto et al. . |
| 4,961,088 | 10/1990 | Gilliland et al. . |
| 4,963,939 | 10/1990 | Kurando et al. . |
| 4,994,853 | 2/1991 | Fukuchi et al. . |
| 5,049,898 | 9/1991 | Arthur et al. . |
| 5,075,724 | 12/1991 | Wada et al. . |
| 5,103,259 | 4/1992 | Saitoh et al. . |
| 5,132,729 | 7/1992 | Matsushita et al. . |
| 5,137,379 | 8/1992 | Ukai et al. . |
| 5,148,534 | 9/1992 | Comerford . |
| 5,184,181 | 2/1993 | Kurando et al. . |
| 5,272,503 | 12/1993 | LeSueur et al. . |
| 5,289,242 | 2/1994 | Christensen et al. . |
| 5,351,159 | 9/1994 | Dodt et al. . |
| 5,363,134 | 11/1994 | Barbehenn et al. . |
| 5,365,312 | 11/1994 | Hillmann et al. . |
| 5,385,416 | 1/1995 | Maekawa et al. . |
| 5,392,102 | 2/1995 | Toyoizumi et al. . |
| 5,410,641 | 4/1995 | Wakabayashi et al. . |
| 5,471,284 | 11/1995 | Fujii et al. . |
| 5,486,899 | 1/1996 | Iimori et al. . |
| 5,489,971 | 2/1996 | Nam . |
| 5,491,540 | 2/1996 | Hirst . |
| 5,506,611 | 4/1996 | Ujita et al. . |
| 5,510,884 | 4/1996 | Bov, Jr. et al. . |
| 5,571,566 | 11/1996 | Suzuki et al. . |
| 5,579,088 | 11/1996 | Ko . |
| 5,610,635 | 3/1997 | Murray et al. . |
| 5,634,169 | 5/1997 | Barry et al. . |
| 5,678,121 | 10/1997 | Meetze, Jr. et al. . |
| 5,699,091 | 12/1997 | Bullock et al. . |

(List continued on next page.)

*Primary Examiner*—Arthur T. Grimley
*Assistant Examiner*—Hoan Tran

(57) ABSTRACT

A consumable component identification and detection apparatus enables a host device to detect and identify a consumable component inserted into the host device, such as a printer. A passive circuit element is embedded into the consumable component and remaining circuit elements are included in the host device so that when the consumable component is in the host device an electrical circuit having known characteristics is completed. The electrical circuit, such as a filter, is energized by a test signal and the output from the electrical filter together with the test signal are input to a characterization circuit to identify/detect the consumable component. A counter/timer may be used as part of the characterization circuit to count clock pulses when the output from the electrical circuit after initial processing is coincident with the test signal. The count is interpreted to identify/detect the consumable component.

12 Claims, 5 Drawing Sheets

U.S. PATENT DOCUMENTS

| | | |
|---|---|---|
| 5,708,912 | 1/1998 | Lee . |
| 5,717,974 | 2/1998 | Park . |
| 5,755,519 | 5/1998 | Klinefelter . |
| 5,757,394 | 5/1998 | Gibson et al. . |
| 5,758,224 | 5/1998 | Binder et al. . |
| 5,807,005 | 9/1998 | Wright . |
| 5,812,156 | 9/1998 | Bullock et al. . |
| 5,826,134 | 10/1998 | Hino et al. . |
| 5,831,649 | 11/1998 | Watrobski et al. . |
| 5,835,817 | 11/1998 | Bullock et al. . |
| 5,847,814 | 12/1998 | Antziopoulos et al. . |

FIG. 1
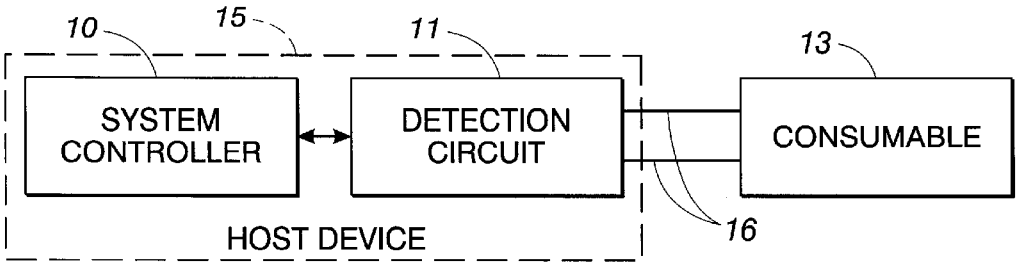
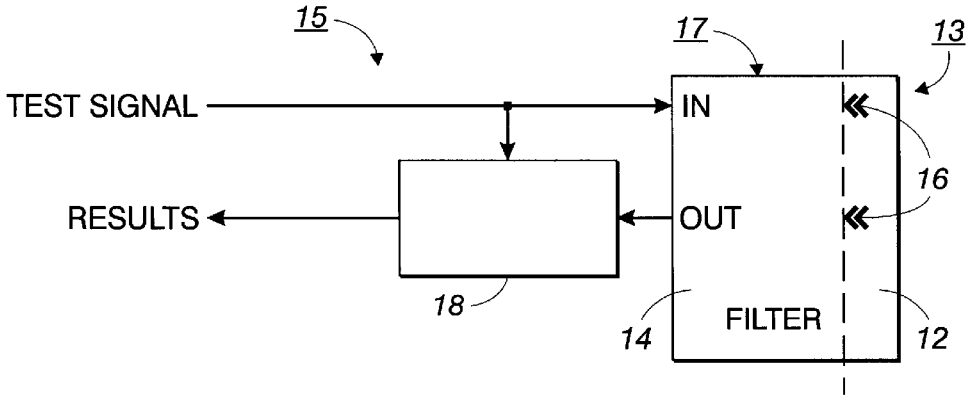
FIG. 2
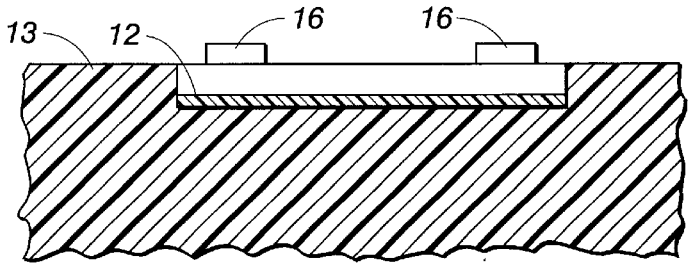
FIG. 3

CONSUMABLE COMPONENT IDENTIFICATION AND DETECTION

BACKGROUND OF THE INVENTION

The present invention relates to consumable components used in a host device, and more particularly to a method of detecting and identifying the consumable components in the host device, such as a printer.

A monochrome or color printing apparatus, which may include printers, copiers, facsimile machines, etc., uses consumable components with a defined useful life and formula characteristics, such as toners and/or ink cartridges, that should be made known automatically to local print process controllers. In recent years there has been an increasing trend toward including some form of identification system on consumable components, especially for printers. The reasons for this trend are to assure that the customer is using compatible consumable components for optimal performance and to help service personnel determine which printer failures were likely caused by the use of non-compatible consumable components. Other reasons include the need to be able to introduce new generations of consumable components recognizable by the printer and to track consumable usage over life such that a "gas gauge" may be used to present the customer with a realistic estimate of remaining life.

The most common previously applied identification methods included the use of write-once and read/write non-volatile electronic memory devices located on the consumable component. These methods add considerable cost to the consumable, require as many as five to six electrical contacts, and normally require special programming at some point in the manufacturing process. Other techniques used include bar code labels, conductive labels and magnetic strips, as well as mechanical codes. Finally various types of electronic identification techniques have been used such as magnetic cards similar to employee electronic badges or memory chips such as EEPROMs. These techniques also tend to be costly due either to the expense of the components added to the consumable or to the cost of the detector or reader in the host device, or tend to have relatively low reliability due to complexity.

What is desired is a method for identifying and detecting consumable components that is simpler, more reliable and less costly than the prior methodologies.

BRIEF SUMMARY OF THE INVENTION

Accordingly the present invention provides a consumable component identification and detection method for use in a host device, such as a monochrome or color printing apparatus, that uses an electrical circuit with known characteristics having one or more passive components as elements of the consumable component while leaving remaining circuit components as elements of a characterization circuit in the host device. A test signal, such as a pulse signal, is input to the electrical circuit and compared with the processed test signal output from the electrical circuit. The comparison result is analyzed and the analysis result is used to access a lookup table to detect the presence and to provide the identification of the consumable component.

The objects, advantages and other novel features of the present invention are apparent from the following detailed description when read in conjunction with the appended claims and attached drawing.

BRIEF DESCRIPTION OF THE SEVERAL VIEWS OF THE DRAWING

FIG. 1 is a basic block diagram view of a system for consumable component identification and detection according to the present invention.

FIG. 2 is a simple block diagram view of an identification circuit for consumable components according to the present invention.

FIG. 3 is a partial cutaway view of a consumable component showing a passive circuit component embedded in the consumable component as part of the identification circuit according to the present invention.

DETAILED DESCRIPTION OF THE INVENTION

Figure 4:
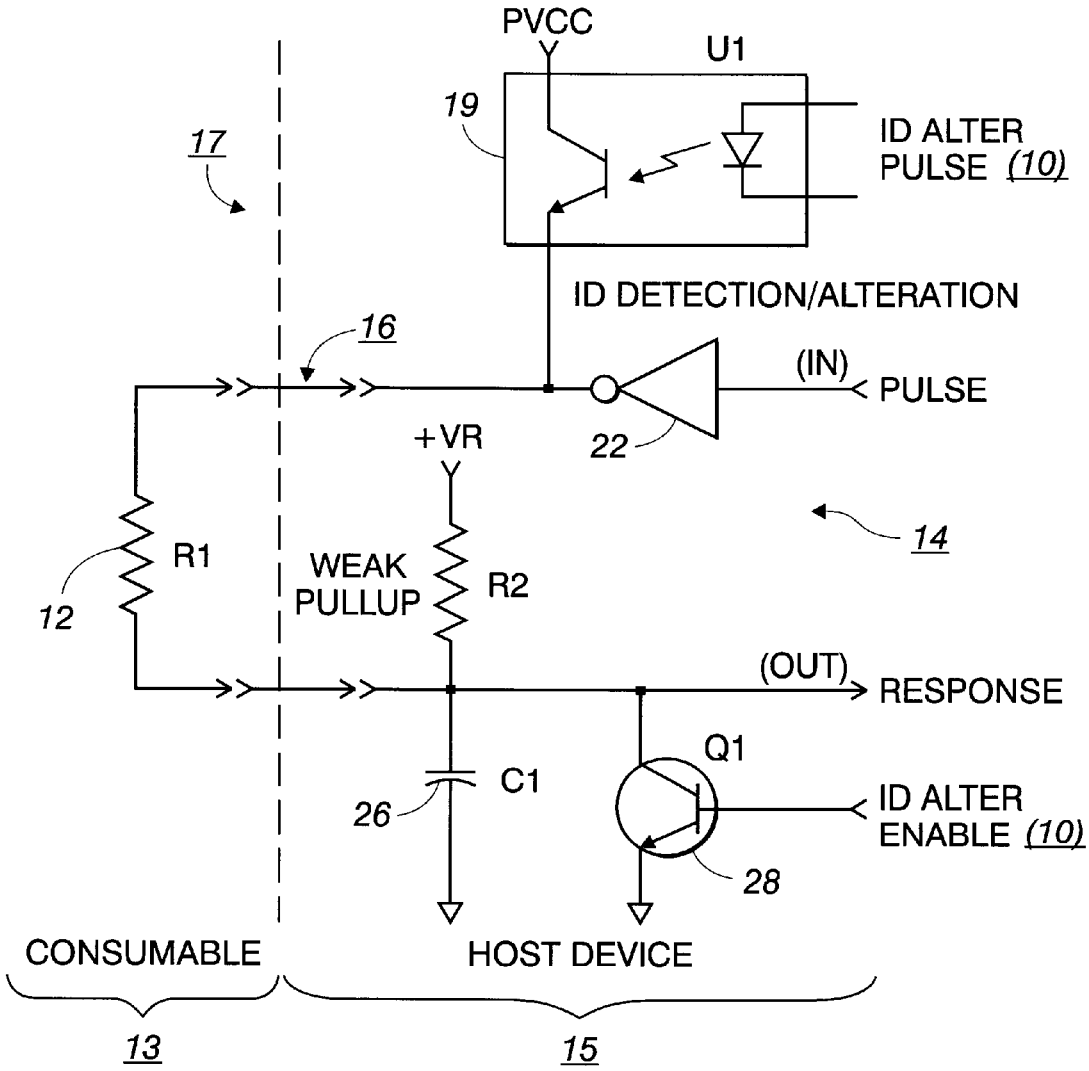
FIG. 4 is a simple schematic diagram of one embodiment of the identification circuit according to the present invention.

A system for consumable identification interfacing is shown simply in FIG. 1 where a consumable component 13 is electrically coupled in its simplest form by two wires to a detection circuit 11, which in turn receives stimuli from and reports results to a system controller 10. The configurations of the components that make up the actual consumable detection circuit 11 determine the methods for identification and alteration of the response.

An electrical filter causes an increase in rise and fall times of an electrical source pulse applied to the filter inputs, and the resultant pulse rise and fall times are a function of the electrical properties of the filter. The rise and fall time properties may be characterized with a pulse generator and pulse detection circuits. If the filter architecture is previously defined and known, and if only one filter element is allowed to be an unknown target variable, the value of the single unknown target variable may be readily determined to within acceptable accuracy. The basic idea is to process a test signal, such as the pulse signal, in a known manner where the output is a function of the passive circuit component in the consumable as the unknown target variable.

As shown in FIG. 2 in the present invention one or more unknown target variable passive elements 12 are incorporated into a consumable component 13, and any remaining circuit elements 14 are incorporated into a host device 15, such as a printing apparatus, in which the consumable component is used. The two circuits formed by the passive element(s) 12 in the consumable component 13 and the remaining circuit elements 14 in the host device 15 are joined together through electrical contacts 16 to form a composite electrical circuit 17, such as a filter circuit, when the consumable component is installed in the host device. As shown in FIG. 3 the passive element(s) 12 may be in the form of a hybrid circuit board embedded into the consumable component 13, leaving only the electrical contacts 16 exposed.

A test signal, such as a pulse signal, is periodically applied to the composite electrical circuit 17 and a characterizing circuit 18. The processed test signal from the electrical circuit 17 also is input to the characterization circuit 18. The characterization circuit 18 may compare the processed test signal to a threshold to produce control signals, and have a counter/timer that is clocked at a fixed and known rate and is enabled by the control signals. The resultant sampled counter value is a function of the following known values, in addition to the unknown target variable value of the passive element 12: circuit starting voltage (allowed to be very nearly zero); detector voltage threshold; counter/timer clock rate; circuit architecture; and other circuit element values.

The simplest implementation of the electrical circuit 17, as shown in FIG. 4, uses a single component on the consumable component 13, such as a resistor 12. The resistor together with a series-connected capacitor 26 in the identification circuit 14 is just one of many possible implementation methods. A single resistor in the consumable component grants access to both terminals of the resistor, and the resistor electrical value may be permanently altered on command by the identification circuit via an opto-electrical interface 19 in response to a proper stimulus from the system controller 10. The new resistor value then may be determined by the identification circuit.

Figure 5:
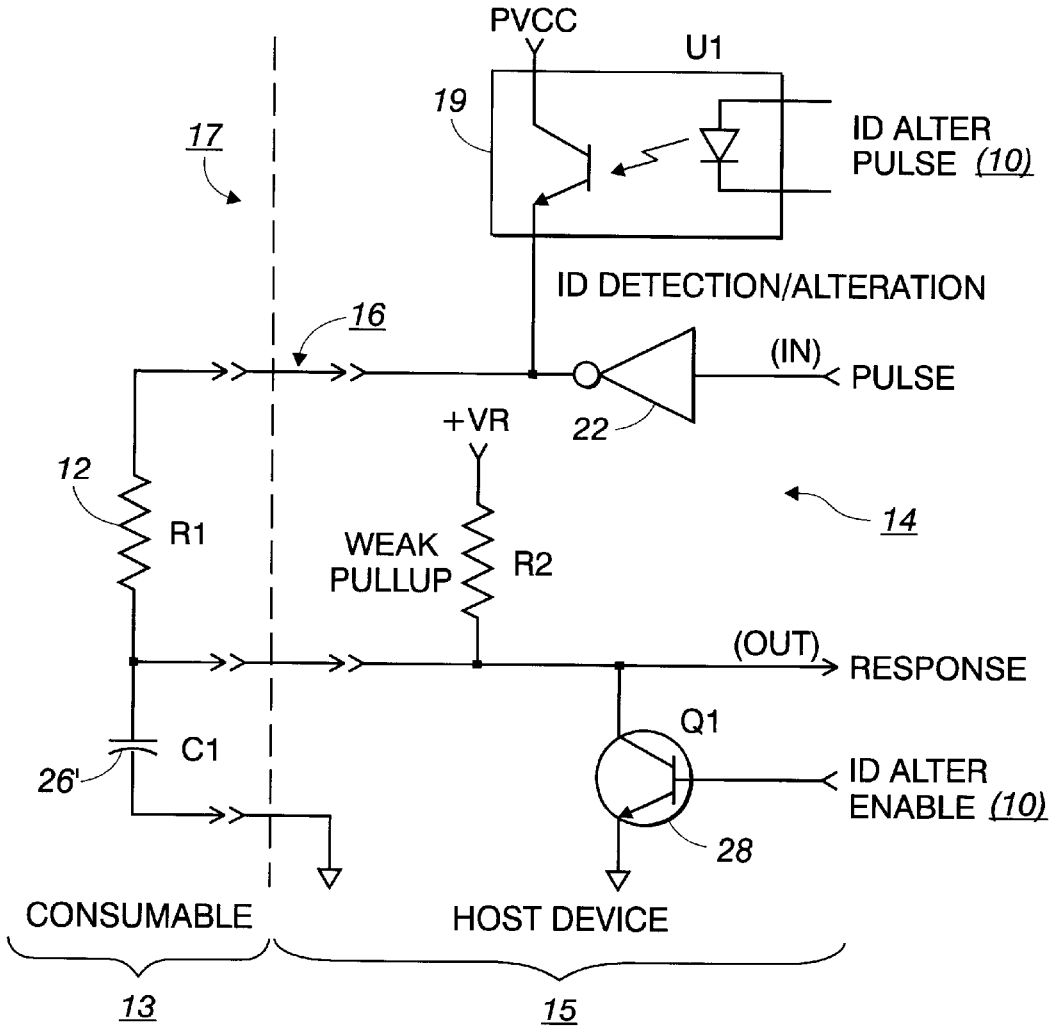
FIG. 5 is a simple schematic diagram of another embodiment of the identification circuit according to the present invention.

An alternative configuration, as shown in FIG. 5, is to include the capacitor 26 with the resistor 12 in the consumable component 13. This configuration requires a third wire between the consumable component 13 and the host device 15 in order to identify the resistor value and alter such value when required.

Figure 6:
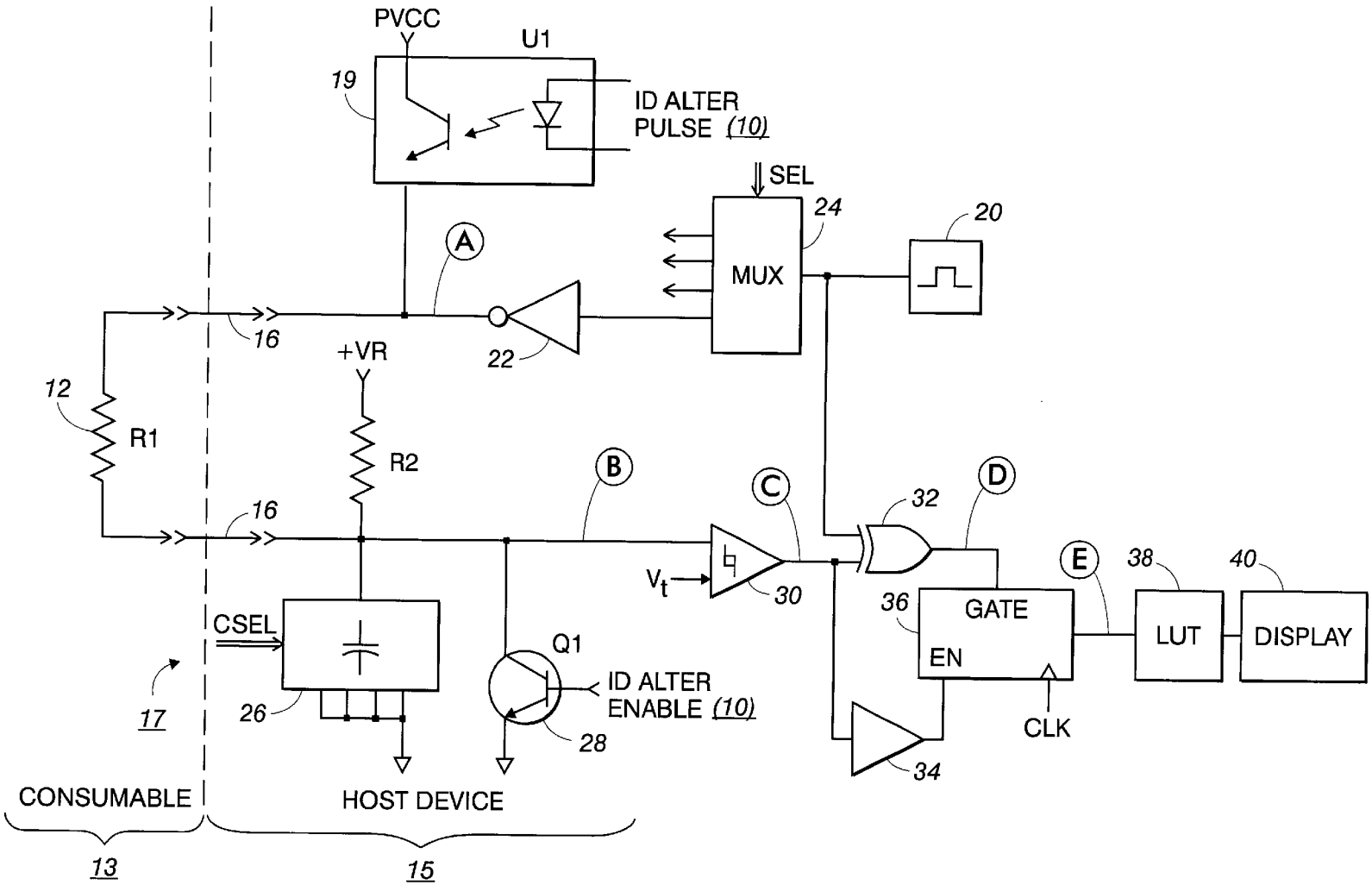
FIG. 6 is a simple schematic diagram view of the system for consumable component identification and detection according to the present invention.
Figure 7:
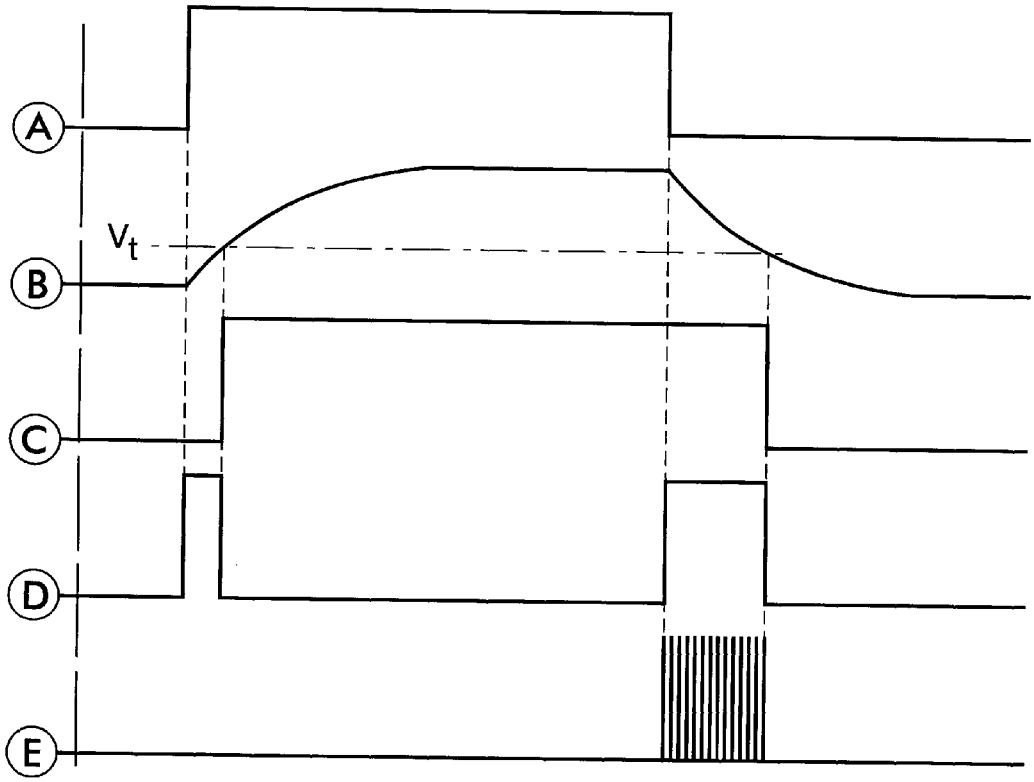
FIG. 7 is a simple waveform view for the schematic of FIG. 6 according to the present invention.

Referring now to FIG. 6 the test signal, in this embodiment a pulse signal from a pulse generator 20 in the system controller 10, is input to a drive circuit 22. The output from the drive circuit 22 is applied through the electrical contacts 16 from the host device 15 to one end of the passive element 12 in the consumable component 13, indicated as being a resistor R1. For multiple consumable components 13 a multiplexer 24 may be used to direct the pulse signal to each consumable component in turn. The other end of the passive element 12 is coupled by the electrical contacts 16 back to the host device 15 to the identification circuit 11, which may include a capacitor C or selectable gang of capacitors 26 coupled to ground. At the junction of the passive element 12 and the capacitor(s) 26 is coupled a switch 28, shown as a transistor having the collector coupled to the junction and the emitter coupled to ground. The switch 28 is used to bypass the capacitor(s) 26 in response to an ID Alter Enable signal applied to the base of the transistor. The junction also provides the output from the electrical filter 17.

The output from the electrical circuit 17 is applied together with a threshold voltage $V_t$ to a hysteresis amplifier or comparator 30. The output from the comparator 30 is input to an exclusive OR gate 32 and an optional buffer amplifier 34. Also input to the exclusive OR gate 32 is the pulse test signal from the pulse generator 20. The output from the comparator 30 via the optional buffer amplifier 34 acts as an enable signal for a counter/timer 36, initially resetting the count to zero. The output from the exclusive OR gate 32 is applied as a gate input to the counter/timer 36. During the intervals when the counter/timer 36 is enabled and the gate signal is present, the counter/timer is incremented by a clock signal. At the end of the enable period the count from the counter/timer 36 is used to address a lookup table 38. The resulting output from the lookup table 38 is provided to a display device 40 to present to a user the detection and identification of the consumable component 13.

To provide an indication to the user that the consumable component 13 has reached or is nearing the end of its lifetime, or based upon some other criteria, an ID Alter pulse is applied via the opto-electrical interface 19 to the passive component 12. A diode (not shown) at the output of the driver circuit 22 may be used to prevent the ID Alter pulse from damaging the driver circuit. The ID Alter Enable signal causes the junction between the circuit components 12, 26 to be held at ground so that the ID Alter pulse is applied completely across the passive component 12 for the duration of the pulse without charging the capacitor 26. The ID Alter pulse causes the passive element to change its value so that the output from the comparator 30 changes, which is applied to the enable and gate inputs of the counter/timer 36 simultaneously via the optional buffer amplifier 34 and exclusive OR gate 32 respectively. The resulting count output from the counter/timer 36 and the corresponding output from the lookup table 38 indicates on the display 40 the appropriate end of lifetime or other message. For this application the consumable components 13 are not designed to be used more than once, i.e., there is no "refill" capability.

In operation a pulse signal (A) is input to the electrical circuit 17 which results, when the consumable component 13 is present to complete the electrical circuit, in an output as shown by waveform (B). The voltage at the junction is initially approximately at ground potential, and the capacitor C charges up through the resistor R during the pulse width and discharges through the resistor R after the pulse. The characteristic of the waveform (B) is determined by the combination of R and C. Since C is known, the characteristic of waveform (B) is determined by R. The output from the comparator 30 shows the enable signal (C) as determined by comparing the output signal from the electrical circuit 17 with the threshold voltage $V_t$. The combination of the pulse test signal (A) and the enable signal (C) in the exclusive OR gate 32 results in the gate signal (D), which has a pulse at the leading edge of the pulse test signal and a pulse at the trailing edge. The counter/timer 36 counts the clock during the trailing edge pulse of the gate signal (D), as shown by (E).

The sampled counter/timer count value is independent of the pulse width of the test signal (A) if the pulse is sufficient in width to allow the circuit output voltage level to reach at least the detection circuit threshold voltage $V_t$. In this situation the counter/timer 36 is enabled by the pulse test signal, and counts the clock during the period that the circuit output signal (B) exceeds the threshold voltage prior to the end of the pulse of the test signal, i.e., the exclusive OR gate 32 is not used and the pulse test signal is applied directly to the counter/timer. A variation of this method enables the counter/timer 36 when the processed pulse exceeds the threshold. This alternative method requires the pulse width of the test signal to be known in order to calculate the pulse width difference from the processed pulse. In either case tables of acceptable values in the lookup table 36 provide for easy validation and invalidation of the unknown target variable element, i.e., the consumable component 13.

The electrical circuit 17 may be configured in such a way as to make the sampled pulse profile very close to the test pulse profile if the current path to the unknown target variable element 12 in the consumable component 13 is permanently electrically opened. In this configuration the unknown target variable element 12 is used as a "once empty" indicator when the current path is permanently opened through controlled action by the ID Alter pulse. The methods to permanently open the electrical circuit 17 may vary depending on the actual makeup of the electrical circuit elements. A single fusible resistor R, for example, may require only a direct current source to force the desired open circuit, as shown in FIGS. 4–6.

The values in the lookup table 38 may be factory calibrated once by connecting known resistors in sequence corresponding to consumable components 13 to be identified across the electrical contacts 16 to determine the corresponding counter/timer 36 count values for each such resistor. The counts are converted into addresses such that, for example, if the count falls between 15 and 20 a consumable component 13 is detected and identified as being of a specific nature as one address of the lookup table; if the count is less than 5 there is no or an empty consumable component detected as another address of the lookup table; if the count is between 5 and 15 a consumable component is detected but identified as not being compatible with the host device as yet another address of the lookup table; etc.

Thus the present invention provides a method of identifying and detecting a consumable component in a host device, such as a printing apparatus, by using an electrical circuit having known characteristics with a passive circuit element in the consumable component and the remaining circuit elements in the host device, comparing the output from the electrical circuit in response to a test signal with a threshold voltage, counting a clock as a function of the test signal and the output of the comparison, and providing an identification/detection output as a function of the count.

What is claimed is:

1. An apparatus for identifying/detecting a consumable component in a host device comprising:

an electrical circuit having a passive circuit element in the consumable component and remaining circuit elements in the host device, the remaining circuit elements being electrically coupled to the passive circuit element via electrical contacts when the consumable component is in the host device, the electrical circuit having an input and an output; and a characterization circuit having an input coupled to the output of the electrical circuit such that, when the electrical circuit is energized by a test signal applied to its input, the characterization circuit identifies/detects the consumable component as a function of the output from the electrical circuit and the test signal, wherein the characterization circuit comprises:

means for comparing the output from the electrical circuit with a threshold voltage to produce an enable signal; and means for combining the enable signal with the test signal to identify/detect the consumable component.

2. The apparatus as recited in claim 1 wherein the combining means comprises:

an exclusive OR gate having the enable signal and test signal as inputs to produce a gate signal as an output; and means for determining from the enable signal and the gate signal an indicator signal to identify/detect the consumable component.

3. The apparatus as recited in claim 2 wherein the determining means comprises:

a counter/timer having the enable and gate signals as inputs, the counter/timer counting a clock signal during the period the enable and gate signals are coincident to produce a clock count; and means for interpreting the clock count to identify/detect the consumable component.

4. The apparatus as recited in claim 3 wherein the interpreting means comprises a lookup table having as an address input the clock count and providing as an output a message to identify/detect the consumable component.

5. The apparatus as recited in claim 4 further comprising means for displaying the message from the lookup table to identify/detect the consumable component.

6. The apparatus as recited in claim 1 wherein the combining means comprises:

means for counting a clock signal when the test signal and enable signal are coincident; and means for interpreting the clock signal to identify/detect the consumable component.

7. The apparatus as recited in claim 1 further comprising means for altering the characteristics of the electrical circuit upon command to provide a lifetime indication for the consumable component.

8. The apparatus as recited in claim 1 wherein the electrical circuit comprises:

a resistor located in the consumable component coupled at its ends to the electrical contacts; and a capacitor located in the host device which is series-connected electrically with the resistor when the consumable component is in the host device.

9. The apparatus as recited in claim 8 wherein the capacitor comprises:

a bank of capacitors; and means for electrically series-connecting a selected one of the bank of capacitors with the resistor.

10. The apparatus as recited in claim 1 wherein the electrical circuit comprises:

a resistor located in the consumable component coupled at its ends to the electrical contacts;

a capacitor located in the consumable component electrically series-connected with the resistor and coupled at its ends to the electrical contacts.

11. A method of determining the identity of a consumable component having an identifying passive circuit component in a host device having additional circuit components, where the identifying passive circuit component and the additional circuit components form an identifying circuit with known characteristics when the consumable is connected to the host device, comprising the steps of:

applying a test signal to the identifying circuit at an input;

extracting a processed test signal from the identifying circuit at an output;

comparing the test signal and processed test signal to obtain a characteristic value;

relating the characteristic value to known characteristic values to identify the consumable component; and displaying the identity of the consumable component as identified from the relationship of the characteristic value to the known characteristic values.

12. The method as recited in claim 11 further comprising the step of altering the characteristics of the identifying passive circuit component upon command to provide a lifetime indication for the consumable component.

* * * * *